United States Patent [19]

Vandame

[11] Patent Number: 4,664,460

[45] Date of Patent: May 12, 1987

[54] ELECTRICAL CONNECTORS

[75] Inventor: Bertrand Vandame, Villepreux, France

[73] Assignee: Precision Mecanique Labinal, Bois D'Arcy, France

[21] Appl. No.: 758,440

[22] Filed: Jul. 24, 1985

[30] Foreign Application Priority Data

Aug. 1, 1984 [FR] France ..... 84 12227

[51] Int. Cl.[4] ..... H01R 11/00

[52] U.S. Cl. ..... 339/59 R; 339/217 S

[58] Field of Search ..... 339/59 R, 59 M, 60 R, 339/60 M, 217 S

[56] References Cited

U.S. PATENT DOCUMENTS

| | | | |
|---|---|---|---|
| Re. 28,126 | 8/1974 | Poingt | 339/59 R |
| 3,648,213 | 3/1972 | Kobler | 339/59 R |
| 3,747,047 | 7/1973 | Carter et al. | 339/59 |
| 3,860,316 | 1/1975 | Hardesty et al. | 339/99 R |
| 3,982,805 | 9/1976 | Irie | 339/59 R |
| 4,013,331 | 3/1977 | Kobler | 339/59 R |
| 4,214,801 | 7/1980 | Cairns et al. | 339/59 R |
| 4,253,718 | 3/1981 | Bungo | 339/59 R |
| 4,359,257 | 11/1982 | Lopinski et al. | 339/99 R |
| 4,557,543 | 12/1985 | McCleerey et al. | 339/217 S |

FOREIGN PATENT DOCUMENTS

| | | |
|---|---|---|
| 0463368 | 7/1975 | Australia . |
| 0533931 | 12/1983 | Australia . |
| 1533862 | 6/1968 | France . |

*Primary Examiner*—Gil Weidenfeld
*Assistant Examiner*—Paula A. Austin
*Attorney, Agent, or Firm*—Sandler & Greenblum

[57] ABSTRACT

An electrical connector including an insulated receptacle having a front wall with openings provided with at least one channel which emerges into a opening for receiving a female electrical contact member. The channel is provided with a means for biasing to cooperate with corresponding means for retention on the electrical contact member so as to ensure the secure positioning of the electrical contact member when it is put in place in the channel. The channel has a cross-sectional dimension greater than of the electrical contact member and tapers gradually on the front face towards the opposite end of the insulating box. The electrical contact member is provided with a flared opening at its end which turns towards the front face of the insulated box. The openings in the front face of the insulated box have dimensions less than those of the corresponding ends of the electrical contact member so that the electrical contact member is retained axially between the means for retaining and the front face of the insulated box, but are permitted to move laterally within the channel.

7 Claims, 5 Drawing Figures insure the retention of the electrical contact member when it is put in place. Each channel may also have a cross-sectional dimension greater than a cross-sectional dimension of the electrical contact member and tapers, preferably gradually, from the front face towards the opposite end of the box.

The electrical contact member of the present invention may be provided with a flared opening at its end turned towards its front face which has dimensions less than those of the corresponding ends of the electrical contact members so that the electrical contact members can be retained axially as well as laterally between the retention members on the means for biasing and the front face.

In accordance with the present invention, the female electrical contact members can be aligned with the male contact members and the connector can be put into place even if the male members are not aligned.

In accordance with yet another feature of the present invention, each means for biasing located in the channels has a step turned towards the front face of the insulating box and each female member has a corresponding lug on two opposite faces which are substituted in the vicinity of the free ends of the female contact members.

Finally, in accordance with a feature of the present invention, each female member is produced from a strip of metal which is a good conductor of electricity, suitably cut out and folded in order to be provided with a flat tubular element bordered by two rounded portions. The end of the female members opposite to the end provided with the flared opening includes means for connection to an electrical conductor.

In FIGS. 1 and 2, a female contact member is represented which is designated by the general reference number 1. The contact member 1 includes a tubular element 2 for receiving a flat male contact element 3 and extension 4 provided with means, shown as feet 5 or 6, for clamping onto an electrical conductor which has previously been bared. The tubular element of the female member is also provided with two parallel flat portions 7 and 8 connected together by two rounded portions 9 and 10. The rounded portions have cross-sections such that they project with respect to the portions 7 and 8. The free end of the tubular element 2 is flared and is provided with two locking lugs 13 on the flat portion 7 while its flat portion 8 is punched through to form a locking lug 15. The lugs 13 and 15 are situated in one an the same plane perpendicular to the longitudinal axis of the female member.

As shown in FIGS. 3 to 5 a box element or receptacle, designated as a whole by the reference number 20, for receiving female contact members like that inn FIGS. 1 and 2, includes two channels 21 and 21*a* as means for receiving a contact member 1. As a practical matter, receptacle 20 can include a large number of channels. The receptacle element 20 is produced from insulating material and displaces a generally parallelepipedal shape with a bottom wall 22, a top wall 23, two sidewalls 24 and 25, and a front wall 26. Each channel 21 is shown as being bound by partitions 28 which gradually approach one another from the rear end towards the front wall 26. The front wall 26 includes two openings 29 which are bordered by a chamfer 30, and connected by a slot 31. There are also provided two slots 32 and 33 aligned with the slot 31, one of which connects the opening 29 to the sidewall 24 and the other of which connects the other opening 29 to the sidewall 25.

A means for biasing described herein as an elastic or a spring foot, having a ramp terminating in a step 35 in the vicinity of its free end, extends from the sidewall 25 in the direction of the front wall 26. In a similar manner, the sidewall 24 includes a means for biasing 36 having a ramp terminating in a step 37.

The receptacle element 20 is also provided with two means for biasing 40 and 41; the means for biasing 40 is situated opposite the foot 34 while the means for biasing 41 is arranged facing the means for biasing 36. These means for biasing 40 and 41 are also provided with steps 42 and 43, respectively, arranged at the level of the steps 35 and 37, and both extending from the central partition 28. The means for biasing 34, 40, 41 and 36 can spring freely as means for retaining the female contact members 1 in position in the channel 21. The separation of the means for biasing 34, 40, 41 and 36 is less than the thickness of the female members 1 at right angles to the flat portion 7 and 8.

One female member 1 is introduced into the channel 21 so that the lug 13 cooperates with either of steps 35 or 42 while the lug 15 cooperates with the other or opposite step. In a similar manner, the second channel 21*a* receives a second female member 1 with the lugs 13, 15 cooperating with the steps 37, 43.

As may be seen in the Figures, the contact members 1 are retained partly by the free ends of the rounded portions 9 and 10 which can but against the inner face of front wall 26 in the vicinity of the openings 29, and by the steps 35, 42, 43 and 37 which cooperate with the lugs 13, 15, although a certain amount of play is provided in order that contact members 1 can function properly that is to say, that the distance separating the inner face of the front 26 from the steps 35, 42, 43 and 37 in channel 21 is greater than the length lying between the active faces of the lugs 13, 15 and the free end of the female member 1.

The minimum passage between the partitions 28, situated at the level of the inner face of the wall 26, is greater than the thickness of the female member 1, thus defining the play of the female member 1 in the channel 21-21*a* which is compatible with the width of the slot 29 in order to insure the entry of the generally flat male contact element 3 into the flare in the free end of female member 1. The slope of the partitions 28 permit the female members 1 to tilt or rotate about the lugs 13, 15 while bearing against one of the steps 35, 37, 42 or 43.

It will be understood that if a male element 3 is not presented directly aligned with an opening 29, it will first butt against the chamfer 30 which will tend to lead it towards the opening 29, and then it will come to meet the flared opening of the tubular element 2 of the contact member 1 with an offset with respect to the longitudinal axis of contact member 1. Continuing its progress, the male element 3 will be inserted into the tubular element 2 of the female contact member 1 then aligning itself with respect to the male member 3. This alignment occurs because of the clearance of the means for biasing 34, 40, 41 and 36, the play provided between the steps 35, 42, 43 and 37, and the inner face of the wall 26, in addition to the slope of the partitions 28. The clearance of the contact members 1 are, however, limited to the play provided between the partitions 28, in order to avoid damaging the means for biasing 34, 40, 41 and 36, if the male members 3 are twisted beyond a certain threshold.

Although flat members 3 have been shown, they may have a different configurations.

ELECTRICAL CONNECTORS

BACKGROUND OF THE INVENTION

Technical Field of Invention

The present invention relates to electrical connectors, particularly electrical connectors of the type including an insulating body having a series of channels for receiving a female electrical contact member, and electrical connectors which are intended for cooperating with a plate or a corresponding box element provided with a series of male electrical contact members for insertion into the female electrical contacts.

Discussion of Information

One of the difficulties with conventional electrical connectors is that the male members must be prevented perfectly aligned with the female members so that the insulating body may be easily put in place. As a practical matter, however, during the course of various manipulations, it frequently happens that one male member of a series is slightly twisted or otherwise off-center so that placement of the insulating body cannot be effected without first straightening the male member.

SUMMARY OF THE INVENTION

Accordingly, one of the goals of the present invention is to provide an electrical connector which facilitates its mounting upon a series of male members even if the male members are not exactly aligned with the female members.

An object of the present invention is to provide an electrical connector including a contanct member having a free end and radial means for retaining the contact member in position, and a receptacle for such contact member including a front wall with at least one opening, and at least one channel emerging into the opening of the front wall provided with means for biasing against the contact member when the contact member is inserted in the channel.

Another object of the present invention is to provide such an electrical connector wherein the means for biasing includes means for securing adapted to cooperate with the means for retaining of the contact member so as to maintain the contact member in axial position when the contact member is inserted in the channel.

A further object of the present invention is to provide such an electrical connector wherein the channel of the receptacle has a cross-sectional dimension greater than a cross-sectional dimension of the contact member and which tapers in a longitudinal direction away from the opening in the front wall of the receptacle.

A still further object of the present invention is such an electrical connector wherein the contact member has a flared free end which faces the opening in the front wall of the receptacle when the contact member is inserted in the channel.

A yet still further object of the present invention is such an electrical connector wherein the receptacle further includes a bottom wall connected to the front wall, two side walls connected to the bottom wall, a top wall connected between the side walls, and a back wall connected to the bottom, top and side walls to close the receptacle.

Another further object of the present invention, is such an electrical connector wherein the receptacle is provided with a plurality of channels emerging into openings in the front wall of the receptacle which are positioned side-by-side within the receptacle and separated from each other by partitions, which are preferably shaped so as to converge towards each other from the back wall of the receptacle. The partitions are preferably provided with means for biasing against contact members when they are inserted in the channels. The means for biasing preferably includes a ramp having a slope which terminates as a step for cooperating with the means for retaining of the contact member to maintain the contact member in axial position when the contact member is inserted in the channel.

Another still further object of the present invention is such an electrical connector wherein the front wall of the receptacle is provided with slots between adjacent openings.

Another yet still further object of the present invention is such an electrical connector wherein the contact member includes a generally hollow section having one end which is a flared free end and another which extends as a means for clamping an electrical connector. The generally hollow section of the contact member includes a substantially flat base surface extending longitudinally between one end and another end of the contact member, two generally U-shaped trough portions extending laterally from either side of the flat base surface and positioned so as to face each other, and an upper flat surface positioned in a plane parallel to the flat base surface connected to each of the trough portions. The trough portions preferably have rounded bottom surfaces with cross-sections which project with respect the flat base surface and the upper flat surface of the contact member.

An object of the present invention is also to provide such an electrical connector wherein means for retaining are provided at a location on the upper flat surface adjacent the free end of the connector, and preferably also in association with the flat base surface in a location opposite to the location of the means for retaining on the upper flat surface.

BRIEF DESCRIPTION OF THE DRAWINGS

The invention will now be described in greater detail by referring to a preferred embodiment given by way of a non-limiting example for illustration purposes only and represented in the attached drawings in which.

DETAILED DESCRIPTION AND PREFERRED EMBODIMENTS

Figure 1:
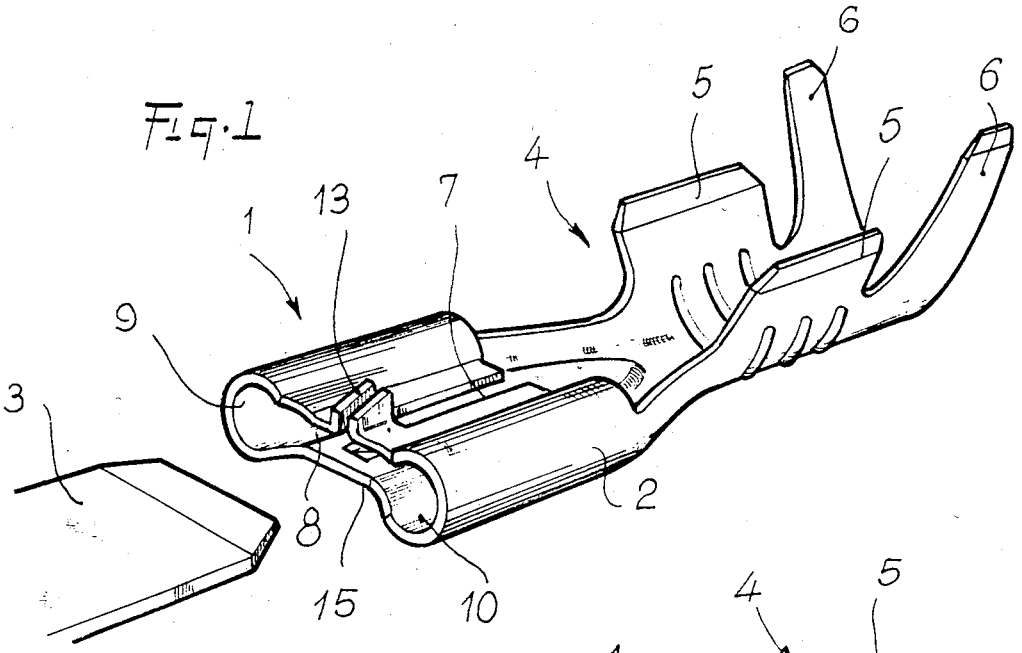
FIG. 1 is a perspective of a female contact member.
Figure 2:
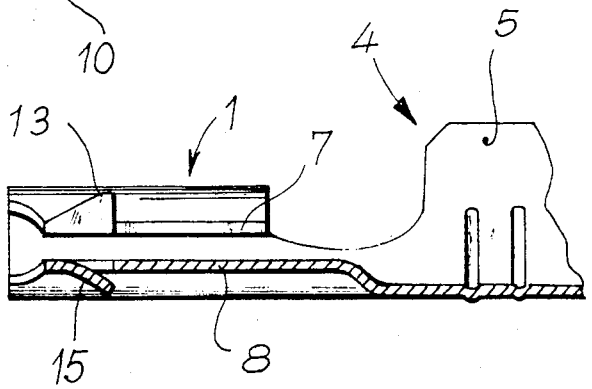
FIG. 2 is a longitudinal section of the member as shown in FIG. 1.
Figure 3:
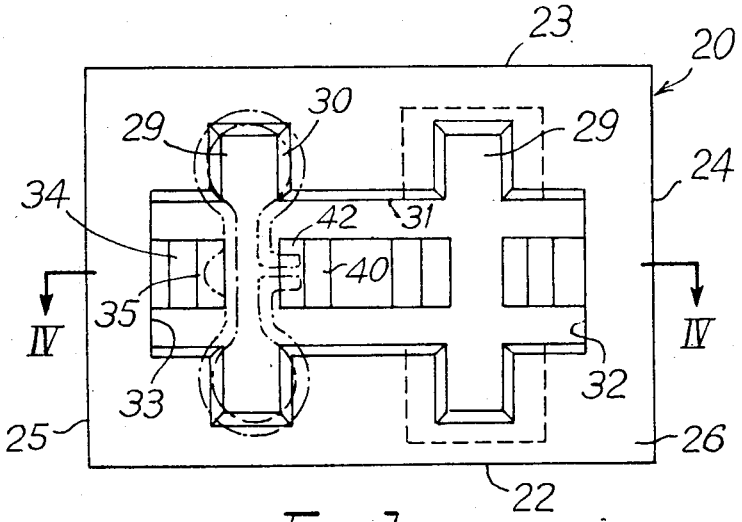
FIG. 3 is a front elevation of a connector box in accordance with the present invention.
Figure 4:
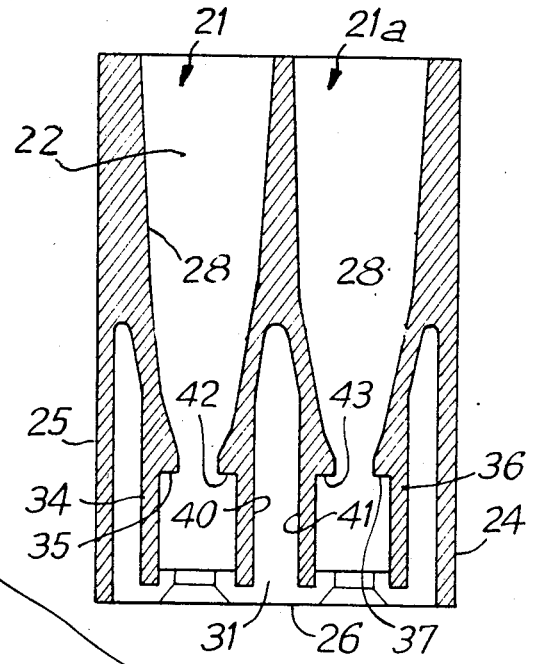
FIG. 4 is a section along the line IV—IV in FIG. 3.
Figure 5:
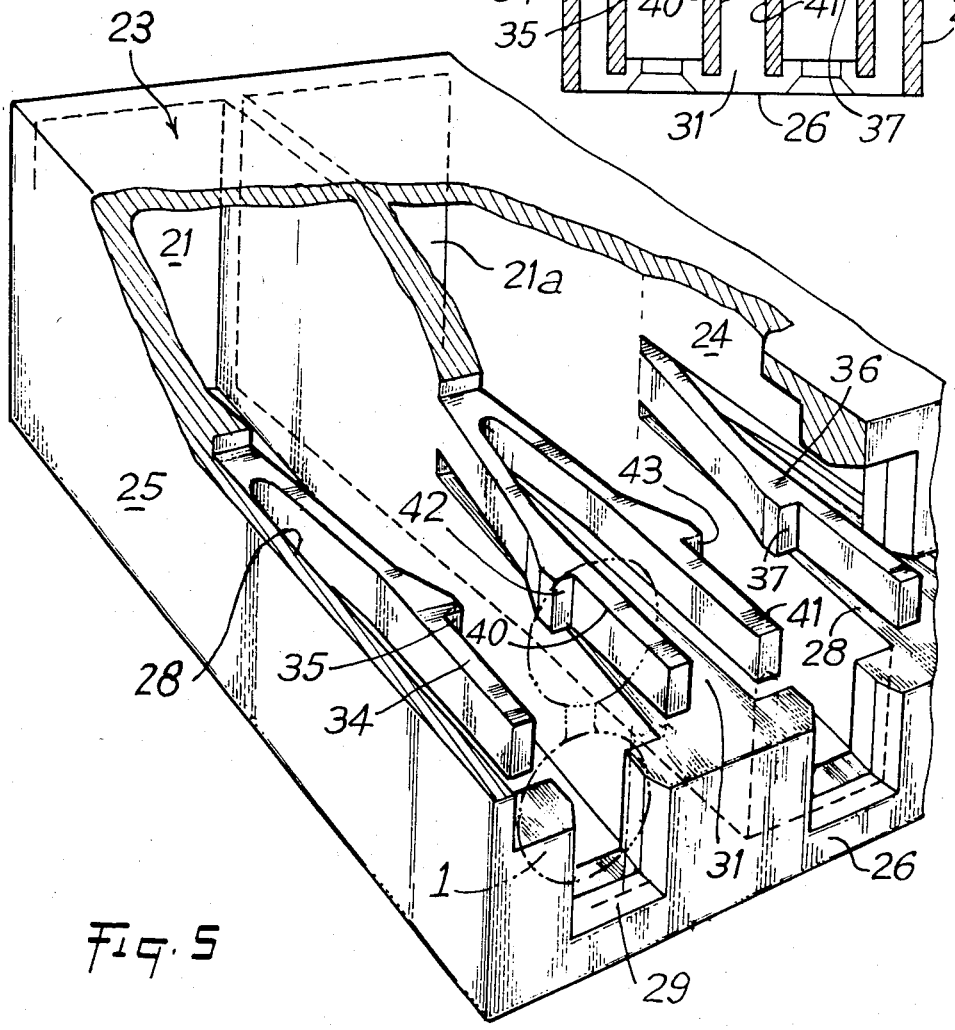
FIG. 5 shows in perspective a box element partly cut away for containing female members, such as those shown in FIGS. 1 and 2.

The connector in accordance with the present invention is the type formed from an insulating box having a front wall provided with openings and exhibiting a series of channels which emerge into the openings in the front wall for receiving one female electrical contact member. Each channel preferably includes two means for biasing or elastic, spring feet having means for retaining which cooperate with corresponding means for securing on the electrical contact member in order to From the foregoing description, one skilled in the art can easily ascertain the essential characteristics of this invention and, without departing from the spirit and scope thereof, can make various changes and modifications of the invention to adapt it to various usages and conditions.

What is claimed is:

1. An electrical contact assembly comprising:

(a) an elongate female contact member having two ends and including:

(i) means for securing an electrical conductor at one end, (ii) a generally hollow section terminating in a flared free end at the other end adapted to receive a male contact member, said hollow section having a length and being provided with radial means for retaining said contact member in position;

(b) an elongate receptacle of generally rectangular configuration for housing said female contact member having a front wall with a plurality of openings therein having a dimension smaller than a dimension of said flared free end and including a plurality of channels each emerging into one of said plurality of openings, wherein said front wall is provided with slots between adjacent openings, said plurality of channels being partially defined by:

(i) a rear wall of said receptacle, and (ii) lateral partitions having inner surfaces extending from said rear wall toward said front wall in a converging manner to describe a portion of said plurality of channel having a cross-sectional dimension greater than a cross-sectional dimension of said means for securing an electrical conductor of said female contact member which is positioned in said portion of said plurality of channels and forming means for biasing adapted to cooperate with said means for retaining said female contact member in an axial position in said plurality of channels, said inner surfaces of said partitions continuing from said portion in an essentially parallel relationship to define with said front wall another portion of said plurality of channels having a length and a cross-sectional dimension greater than the length and cross-sectional dimension of said hollow section of said female contact member which is positioned in said another portion of said plurality of channels, wherein said plurality of channels are positioned side-by-side within said receptacle and separated from each other by said partitions, whereby said female contact member is permitted to move laterally as well as axially to a limited extent within said channel so as to permit the insertion of a male contact member into the flared free end of said female contact member when said male member and said female member are not perfectly aligned along a common longitudinal axis.

2. An electrical connector in accordance with claim 1, wherein said opening is provided with edges which are chamferred.

3. An electrical connector in accordance with claim 1, wherein said means for bising includes a ramp having a slope which terminates in a step facing said front wall for cooperating said means for retaining to maintain said female contact member in axial position when said female contact member is positioned in said channel.

4. An electrical connector in accordance with claim 1, wherein said generally hollow section of said female contact member comprises:

(a) a substantially flat based surface extending longitudinally between said one said and said another end;

(b) two generally, U-shaped trough portions extending laterally from either side of said flat base surface and positioned so as to face each other; and (c) an upper flat surface positioned in a plane parallel to said flat surface connected to each of said trough portions.

5. An electrical connector in accordance with claim 4 wherein said trough portions have rounded bottom surfaces with cross-sections which project with respect to said flat base surface and said upper flat surface.

6. An electrical connector in accordance with claim 5, wherein said means for retaining are positioned at a location along said upper flat surface adjacent said free flared end of said connector.

7. An electrical connector in accordance with claim 6, wherein said means for retaining are positioned on said flat base surface at a location opposite said location of said means for obtaining on said upper flat surface.

* * * * *

UNITED STATES PATENT AND TRADEMARK OFFICE

CERTIFICATE OF CORRECTION

PATENT NO. : 4,664,460

DATED : May 12, 1987

INVENTOR(S) : Bertrand VANDAME

It is certified that error appears in the above-identified patent and that said Letters Patent is hereby corrected as shown below:

In the Abstract, line 3, change "a" to ---an---.

In the Abstract, line 20, change "are" to ---is ---.

At column 1, line 17, change "prevented" to ---presented---.

At column 1, line 33, change "contanct" to ---contact---.

At column 3, line 49, change "an" to ---and---.

At column 3, line 53, change "inn" to ---in---.

At column 4, line 2, change "spring" to ---springy---.

At column 4, line 28, change "but" to ---abut---.

At column 4, line 68, change "configurations" to ---configuration---.

At column 6, line 17, i.e., at claim 3, line 2, change "bising" to ---biasing---.

At column 6, line 26, i.e., at claim 4, line 5, change "said" (second occurrence) to ---end---.

Signed and Sealed this

Fourth Day of December, 1990

*Attest:*

HARRY F. MANBECK, JR.

*Attesting Officer*

*Commissioner of Patents and Trademarks*